US005504964A

United States Patent [19]

McDaid

[11] Patent Number: 5,504,964

[45] Date of Patent: Apr. 9, 1996

[54] CHIMNEY FLUE CLEANING APPARATUS

[76] Inventor: William F. McDaid, 150 Middle Ridge Rd., Bridgton, Me. 04009-9511

[21] Appl. No.: 994,258

[22] Filed: Dec. 21, 1992

[51] Int. Cl.[6] ..... F23J 3/00

[52] U.S. Cl. ..... 15/249.3; 15/104.069

[58] Field of Search ..... 15/242, 243, 249, 15/89, 91, 104.14, 93.1, 104.095, 104.068, 104.069, 249.2, 249.3

[56] References Cited

U.S. PATENT DOCUMENTS

| | | | |
|---|---|---|---|
| 1,515,410 | 11/1924 | Renner | 15/249 |
| 3,120,020 | 2/1964 | Schell | 15/249 |
| 4,433,449 | 2/1984 | Rainey | 15/243 |
| 4,454,625 | 6/1984 | Kern | 15/249 |
| 4,747,177 | 5/1988 | Drechsel | 15/249 |

FOREIGN PATENT DOCUMENTS

| | | | |
|---|---|---|---|
| 8600391 | 1/1986 | WIPO | 15/243 |

*Primary Examiner*—Edward L. Roberts, Jr.

*Attorney, Agent, or Firm*—Chris A. Caseiro; Thomas L. Bohan

[57] ABSTRACT

A chimney flue cleaning apparatus that involves use of a rotating chain suspended from the outlet of the chimney and depending to the bottom of the chimney through which means is provided for the attachment of an ordinary drill tool to the chain through use of a flexible cable extension with a detachable connection for the lower end of the chain. At times when the cleaning is to be done the electric drill is connected into its clamp coupling to the end of the cable extension that is journaled in the chimney wall so that high rotation is given to the chain to extend chain element from the rotating chain that will with whipping washing action engage the inner surface of the chimney to remove hardened soot therefrom.

6 Claims, 2 Drawing Sheets

CHIMNEY FLUE CLEANING APPARATUS

Figure 1:
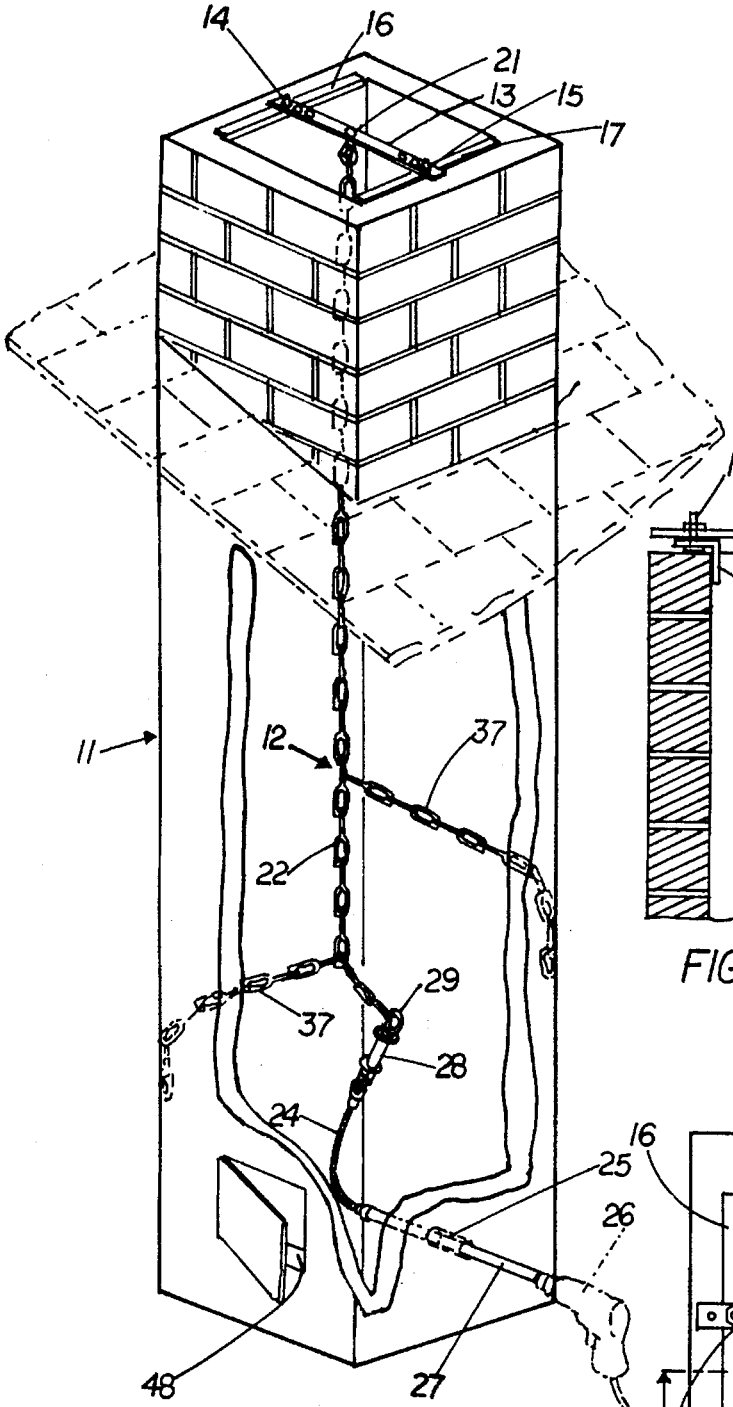

Heretofore, chimney flue cleaning apparatus have embodied brushes for engagement with the inner surface of the chimney to remove the soot and the operation has been such as to raise and lower the brushes for effecting the cleaning operation, and if left in the chimney consumed much space. Arrangements are shown in U.S. Pat. Nos. 614,874, 1,464,249, 1,875,613 and 4,794,622. Usually a crank is used to raise and lower the brushes which is time-consuming to effect the final operation and inefficient in the cleaning of the surfaces. Often, a difficult hard formation is collected on the surface of the chimney which cannot be eradicated by a mere brushing operation. If rotational equipment is to be used, it is necessary that the material be rugged, durable and effective against the hard-caked soot.

Such parts for this purpose is found in a chain that can be rotated at high speed and which carries small chains that will, as the inner chain is rotated, extend and effect heavy blows upon the inner chimney surface removing thereby even the hard and caked-on soot. By a simple attachment to the top of the chimney, a central chain is attached for rotation and made available at the bottom of the chimney for the attachment thereto of a flexible cable extension rotatable carried by the chimney wall and having a connection into which an electric drill can be extended for rotatably driving the full arrangement within the chimney so as to extend its side chains and effect cleaning of the chimney upon the engagement with the inner surface. The loose chain links render a flexibility such that the chains will be extended into the corners of the chimney and provide a very satisfactory cleaning operation. The use of the hand drill need only to be made periodically applied to maintain the chimney in a clean condition and chains being left within the chimney and adapted to be driven at various times.

It is the principal object of the invention to provide a chimney flue cleaning apparatus which is effective and adapted to remove hard cakes of soot from the interior of the chimney, as well as the relatively loose soot.

It is another object of the invention to provide a chimney flue cleaning apparatus in which the cleaning is effected by rotation of a durable depending flexible chain arrangement rotatably supported from the top of the chimney and which employs side chains that will be expanded for engagement with the inner surface of the chimney upon being driven from the lower end of the chain by flexible cable connection and hand drill.

It is still another object of the invention to provide a fixed attachment within the chimney that can remain therein which there extends a flexible cable for connection with the lower end of the chain to rotate the chain about its suspended axis on being driven by a hand drill.

Further objects of the invention are to provide a chimney flue cleaning apparatus, having the above objects in mind, which is of simple construction, inexpensive to manufacture and assemble, has a minimum number of parts, is easy to operate and efficient and effective in use.

Figure 3:
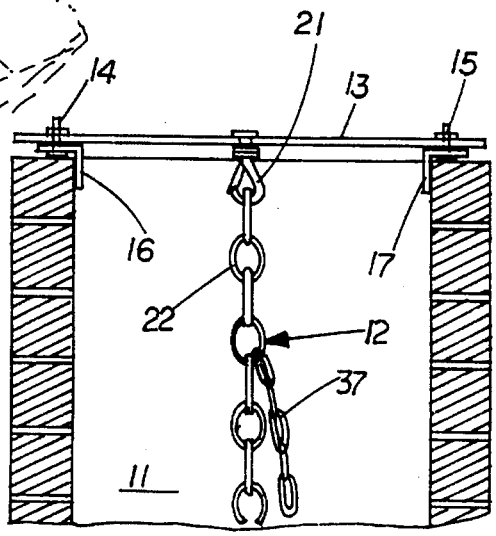
Figure 2:
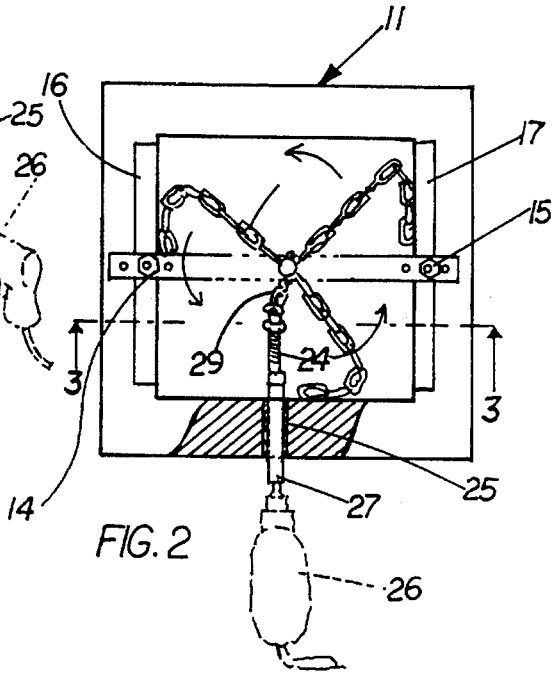
Figure 4:
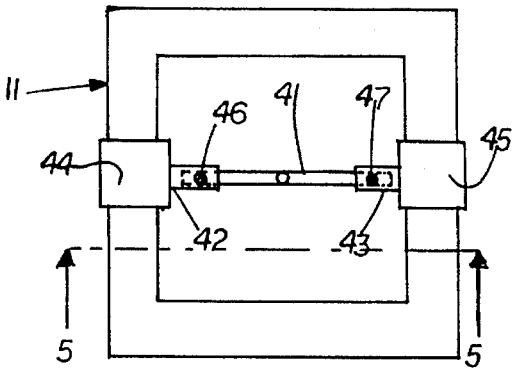
Figure 5:
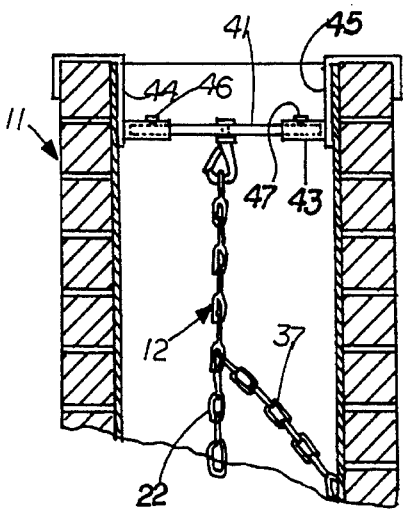
Figure 6:
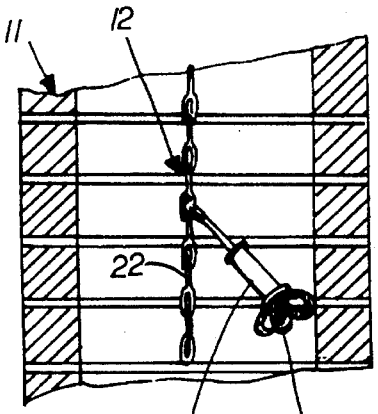
Figure 7:
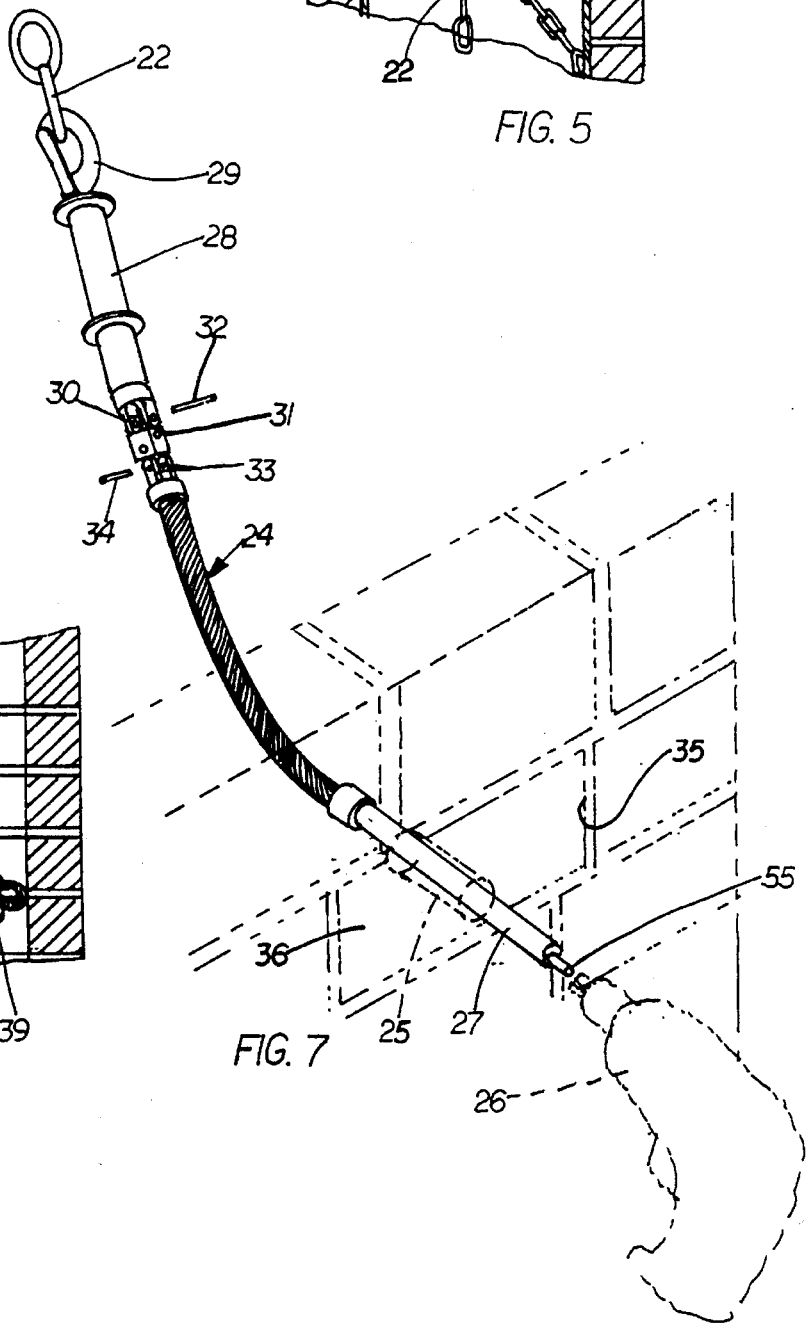

For a better understanding of the invention reference may be had to the following detailed description taken in connection with the accompanying drawing, in which FIG. 1 is a fragmentary perspective view of a chimney extended upwardly through a roof shown in phantom and from which there is suspended the rotatable chain with portions of the chimney broken away to show the side cleaning chain parts expanded therein and the flexible cable extension in the chimney wall for the external engagement of an electric drill tool, FIG. 2 is a top plan view of the chimney looking into the same and upon the cleaning chain apparatus suspended from the top thereof, FIG. 3 is an enlarged sectional view taken generally on line 3—3 of FIG. 2, FIG. 4 is a top plan view of a modified form of attachment to be connected to the top of the chimney for the suspension of the cleaning chain apparatus therefrom, FIG. 5 is a sectional view taken generally on line 5—5 of FIG. 4, FIG. 6 is a fragmentary vertical sectional view of the chimney employing a differently type of extendable side cleaning member formed of a clustered cable, FIG. 7 is an enlarged perspective view of a flexible cable extension that is journaled in the brick of the lower chimney wall and is connected to the lower end of the central chain to effect its rotation from its spindle connection with the top of the chimney.

Referring now particularly to FIGS. 1, 2, 3 and 7, there is shown generally a chimney 11 formed of bricks cemented together in the well-known manner and in which the present chimney flue cleaning apparatus indicated generally at 12 is suspended from the top surface of the chimney by a cross rod 13 fixed at its opposite ends by screws 14 and 15 extended into any of a series of holes thereat and raised respectively from top cleats 16 and 17 and made secure with nuts 18 and 19, FIG. 2. Intermediate the length of the cross rod 13, there is journaled a snap fastener spindle 21 by which the flue cleaning chain apparatus 12 is attached for rotation and in a removable manner.

This flue cleaning apparatus chain 12 includes a long central chain 22 that will be rotated by a flexible cable extension 24 at the bottom of the chimney and journaled in a sleeved opening 25 in the chimney wall to be driven by a hand drill 26 detachably connected to the flexible cable extension 24 through its rigid shaft 27 that extends through sleeved opening 25 and external of the chimney, FIG. 7. The lower end of the chain 22 is weighted by a weight member 28, FIG. 7 attached thereto by a spring clip 29, to best tend to keep the flexible chain apparatus 12 vertically and downwardly extended from the cross shaft 13. This lower end of the weighted member 28 is removably coupled with the flexible cable extension 24 by prongs 30 extending respectively from the weighted member 28 and into an intermediate connecting block 31 made secure with pin 32 and with prongs 33 from the flexible cable extension and pin 34 in the intermediate connecting block 31. In this manner the flexible cable extension 24 can be detached from the weighted member 28. An opening is provided in the chimney wall and closed by a loose brick 36 that can be removed for access through the opening to replace the flexible cable extension 24 and the flexible chain apparatus 12 for hook up purpose.

Connected to the central chain 22 is a series of side cleaning chain elements 37 that will extend under centrifugal force from the central chain 22 when axially rotated by the hand drill 26 through the connection of the cable extension 24 and weighted member 28 thereto. The spacing of the side chains 37 is made such that the cleaning of the respective chains by rubbing against the wall surfaces will overlap so that a continuous cleaning of the chimney surface is assured from top to bottom. The number of chains that are needed will be determined from the length of the chimney and the spacing may vary from the bottom to the top where less cleaning action is needed, but in all cases their cleaning contact with this chimney inner surface should overlap one another for full cleaning action upon the chimney. Without the side chains and by virtue of the use of the flexible cable drives as it is from the side wall and the flexible cable connected as it is to the lower end of the central chain 22, a whipping or wobbling action is given to the central chain, such that it will effect substantial cleaning action of its side chains 37 upon the soot bearing surface of the chimney through engagement therewith. The weight 28 enhances the wobbling action of the suspended central chain 22 as the rotation of the flexible cable 24 is effected by the hand drill 26.

Referring now to FIG. 6, there is shown a cleaning member 38 that is weighted and has an asselblage of cable 39 on its outer end for soft engagement with the inner surface of the chimney upon its being extended by the rotational action of the central chain 22. This cleaning member 38 will be used when the soot is of a soft nature to break up the soot whereas the side chains of the first form of the invention are needed for hard-caked collections of soot.

Referring now to FIGS. 4 and 5, there is shown a different type of cross member arrangement for the top of the chimney in which a cross member 41 will have its ends respectively extended into sleeve projections 42 and 43 of respective cleats 44 and 45 fixed over the top bricks of the chimney. Respective fastening screws 46 and 47 in the respective sleeves 42 and 43 secure the cross member 41 against axial displacement in the cleat sleeves 42 and 43. It should be understood that with this manner of connecting the chain apparatus to the upper end of the chimney with both forms that the attaching chain assemblies are adjustable to different widths of the chimney.

As best seen in FIGS. 1 and 7, one of the bricks of the solid chimney is drilled to receive the sleeved 25 in a tight fitting manner and in which the shaft extension 27 of the lower end of the flexible cable extension 24 is journaled. Rotation of the hand tool is thus applied to the flexible cable 24 and weight member 28 of the chain apparatus 12 by virtue of the same extending laterally with the drive axis off center from the depending central chain causes the central chain 22 to wobble upon being rotated and the side chains to be extended under centrifugal action. By wear of the flexible cable 24, it should be apparent that with access to the interior of the chimney, the flexible cable 24 can be replaced through the detachable clip connection 29 of the weighted member 28 with the lower end of the central chain 22. The arrangement is such with the connection of the hand drill thereto that a fairly rigid drive is effected upon the chain and the chain kept generally in its vertical extended position but can reflect adequately to permit the side chain arms and the central chain 22 to engage the inner surfaces of the chimney to remove soot therefrom. As seen in FIG. 1, a separate door opening assembly 48 is provided in another side wall of the chimney through which access can be had to the interior of the chimney to replace a cable extension and removal of the chain assembly 12. This can be the usual door in the bottom of the chimney for removal of soot gathered from the chimney operation.

It should now be apparent that there has been provided a chimney flue cleaning apparatus which is durable, effective, will have little wear and will be suitable for removal of all different hardness formations of soot that may have been deposited on the inner surface of the chimney, including the hard cakes of soot material.

While various changes may be made in the detail construction, it should be understood that such changes shall be within the spirit and scope of the present invention as defined by the appended claims.

What is claimed:

1. A chimney flue cleaning apparatus comprising a cross member attachment adapted for connection to the top of a chimney, a cleaning assembly having a central flexible link chain rotatably connected to, the cross member attachment and extending freely therefrom from the top to the bottom of the chimney and a flexible drive cable extension connected to the lower end of the central chain and adapted for the connection of a drill tool thereto whereby upon axial rotation of the flexible cable connection the link chain contacts the inner surface of the chimney to affect a cleaning action thereupon.

2. A chimney flue cleaning apparatus as defined in claim 1 and said attachment for the apparatus to the chimney including a cross member and cleats adapted for connection to the sides of the chimney and said cross member being adjustable connected to the cleats to allow its adaptation to different width chimneys.

3. A chimney flue cleaning apparatus as defined in claim 1, said cleaning assembly further including side cleaning elements respectively connected to the central chain and at spaced intervals thereon for extension into the corners of the chimney.

4. A chimney flue cleaning apparatus as defined in claim 3 wherein said extendable side cleaning elements are formed of chain links.

5. A chimney flue cleaning apparatus as defined in claim 4 and the attachment of the flexible drive cable extension, including a solid rod adapted to be journalled in the chimney wall and having a projection on the end of the rod for the reception of the claws of the hand tool.

6. A chimney flue cleaning apparatus as defined in claim 1 and a weighted member (attached) detachably connected to the lower end of the central chain to maintain a degree of lateral rigidity for the chain and said flexible drive cable extension being connected to the weighted member and extending laterally therefrom to effect a wobbling action upon the chain link assembly.

* * * * *